US007294072B2

(12) United States Patent
Montecchia

(10) Patent No.: US 7,294,072 B2
(45) Date of Patent: Nov. 13, 2007

(54) HOCKEY STICK BLADE

(76) Inventor: Nick Montecchia, 91 Strawberry Drive, Hamilton, Ontario (CA) L8E 4R3

( * ) Notice: Subject to any disclaimer, the term of this patent is extended or adjusted under 35 U.S.C. 154(b) by 0 days.

(21) Appl. No.: 11/398,623

(22) Filed: Apr. 6, 2006

(65) Prior Publication Data

US 2006/0240918 A1 Oct. 26, 2006

Related U.S. Application Data

(60) Provisional application No. 60/669,930, filed on Apr. 11, 2005.

(51) Int. Cl.
*A63B 59/14* (2006.01)

(52) U.S. Cl. ..... 473/563

(58) Field of Classification Search ..... 473/560–563
See application file for complete search history.

(56) References Cited

U.S. PATENT DOCUMENTS 5,676,608 A * 10/1997 Christian et al. ..... 473/563
5,685,792 A * 11/1997 Ruoff ..... 473/563
5,906,550 A * 5/1999 Kingston ..... 473/320
5,997,970 A * 12/1999 You ..... 428/36.2
6,234,923 B1 * 5/2001 Gentile ..... 473/563
6,273,835 B1 * 8/2001 Battis et al. ..... 473/563
6,626,775 B2 * 9/2003 Tiitola ..... 473/563
6,916,035 B2 * 7/2005 Houser et al. ..... 280/602
6,955,619 B1 * 10/2005 Schutz et al. ..... 473/560
2005/0075201 A1 * 4/2005 Cullen et al. ..... 473/559
2005/0215362 A1 * 9/2005 Schutz et al. ..... 473/560
2006/0293128 A1 * 12/2006 Frischmon et al. ..... 473/560

* cited by examiner

*Primary Examiner*—Mark S Graham
(74) *Attorney, Agent, or Firm*—Robert F. Delbridge

(57) ABSTRACT

A hockey stick blade has a puck impacting portion with at least one groove extending along the length of the blade. The groove contains a titanium thermoset substantially co-planar with the surface of the blade.

9 Claims, 1 Drawing Sheet

HOCKEY STICK BLADE

RELATED APPLICATION

This invention claims priority from U.S. provisional patent application No. 60/669,930 filed Apr. 11, 2005

FIELD OF INVENTION

This invention relates to hockey stick blades.

BACKGROUND OF INVENTION

Hockey stick handles and blades have traditionally been made of wood. At the present time, some hockey sticks are being manufactured from composite materials, such as carbon-fiber containing material and composite materials such as those sold under the trademark Kevlar. While hockey sticks of composite material have perceived advantages over traditional wooden hockey sticks, they tend to be offset by disadvantages such as higher cost, lack of durability and the inability of players to "feel" the puck when stick handling.

It is therefore an object of the present invention to improve the performance of the traditional wooden hockey stick blade by improving its durability and toughness without compromising its "feel".

SUMMARY OF INVENTION

According to the invention, a hockey stick blade has a puck impacting portion which has at least one groove extending along the length of the blade, with each groove containing a titanium thermoset 18 substantially co-planar with the surface of the blade. As a person skilled in the art will be aware, a titanium thermoset 18 is a titanium-reinforced epoxy putty with a high temperature strength, high temperature resistance and is resistant to chemicals and most acids. Advantageously, there are two or more such grooves in spaced parallel relationship.

Although the use of titanium thermoset 18 in accordance with the invention is most beneficial when used with wooden hockey stick blades, the invention can also be used to increase the performance of hockey stick blades of other material, such as graphite.

It has been found that hockey stick blades in accordance with the invention provide more energy transfer from the blade to the puck, resulting in a significantly faster and thus harder slap shot. When the invention is utilized with a wooden hockey stick blade, the durability, toughness, fatigue resistance and blade stiffness are improved while puck "feel" is minimally affected.

DESCRIPTION OF DRAWINGS

One embodiment of the invention will now be described by way of example with reference to the accompanying drawings, of which.

DESCRIPTION OF PREFERRED EMBODIMENT

Figure 1:
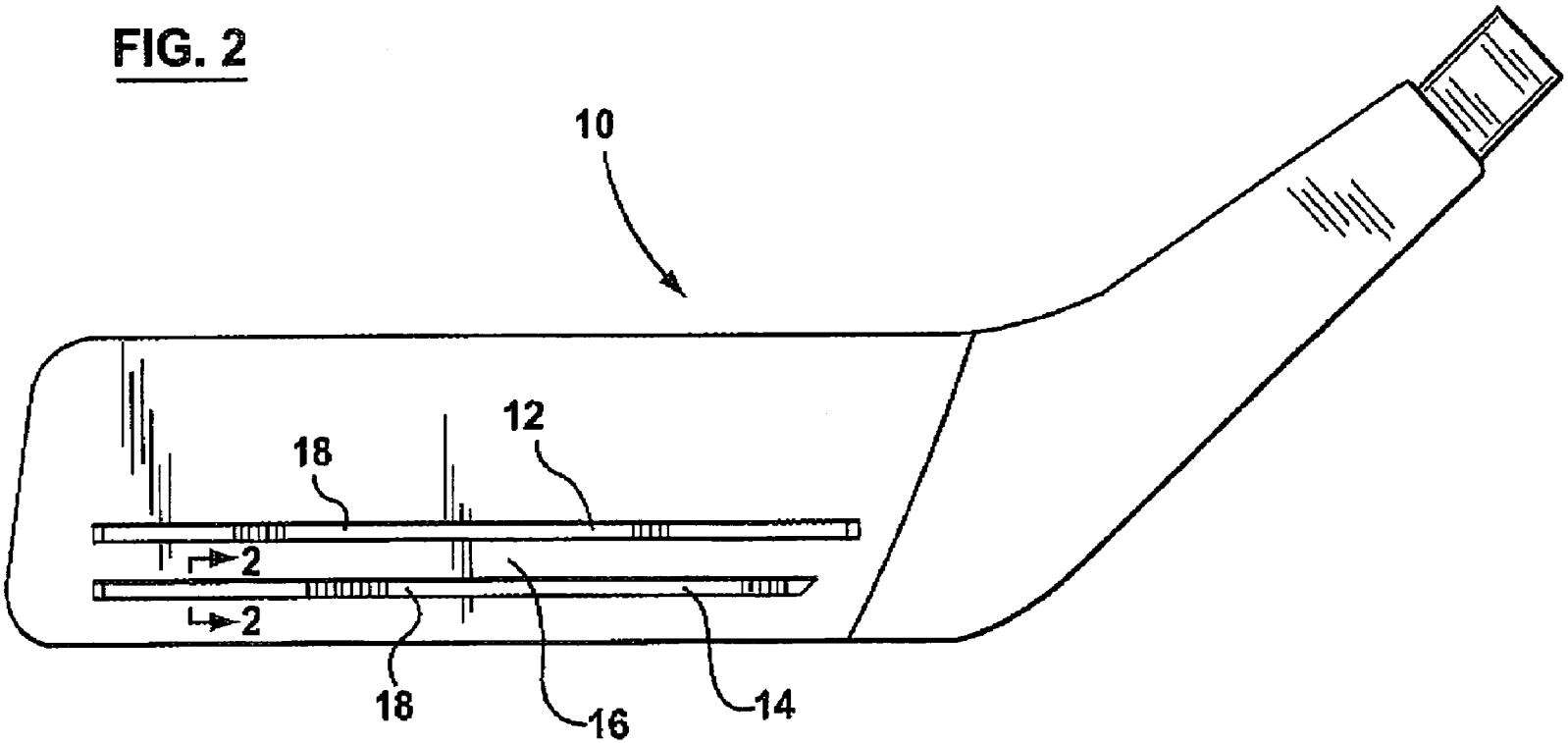
FIG. 1 is a front view of a hockey stick blade.
Figure 2:
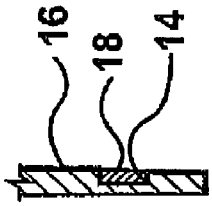
FIG. 2 is a sectional view of a hockey stick blade taken along the line A-A of FIG. 1

Referring to the drawings, a wooden hockey stick blade 10 has a pair of spaced parallel grooves 12, 14 extending longitudinally along its puck impact area 16. Each groove 12, 14 is filled with a titanium thermoset 18 so that the titanium thermoset 18 is co-planar with the surface of the blade 10. A preferred titanium thermoset 18 is sold under the name "Devcon Titanium Putty".

Each groove may have a length of from about 1 to about 10 inches, a width of from about 0.25 to about 0.5 inches and a depth of from about 0.03 to about 0.25 inches. The titanium thermoset 18 should be substantially co-planar with the blade surface and may project up to about 0.06 inches thereabove.

The advantages of the invention and further embodiments thereof will now be readily apparent to a person skilled in the art, the scope of the invention being defined in the appended claims.

The invention claimed is:

1. A hockey stick blade having a puck impacting portion with at least one groove extending along the length of the blade, said groove containing a titanium thermoset substantially co-planar with the surface of the blade.

2. A hockey stick blade according to claim 1 wherein each groove has a length of from about one to about ten inches.

3. A hockey stick blade according to claim 1 wherein each groove has a width of from about 0.25 to about to 0.5 inches.

4. A hockey stick blade according to claim 1 wherein each groove has a depth of from about 0.03 to about 0.025 inches.

5. A hockey stick blade according to claim 1 wherein the titanium thermoset projects up to about 0.06 inches above the blade surface.

6. A hockey stick blade according to claim 1 wherein the puck impacting portion is wooden.

7. A hockey stick blade according to claim 1 wherein the puck impacting portion is graphite.

8. A hockey stick blade according to claim 1 wherein the puck impacting portion is wooden, and each groove has a length of from about one to about ten inches, a width of from about 0.25 to about 0.5 inches and a depth of from about 0.03 to about 0.25 inches.

9. A hockey stick blade according to claim 8 wherein there is a pair of said grooves in spaced parallel relationship.

* * * * *